US005101725A

United States Patent [19]

Kobler et al.

[11] Patent Number: 5,101,725

[45] Date of Patent: Apr. 7, 1992

[54] HOLDER SYSTEM FOR A PRINTING MACHINE DOCTOR BLADE

[75] Inventors: Ingo Kobler, Anhausen; Thomas John, Augsburg, both of Fed. Rep. of Germany

[73] Assignee: Man Roland Druckmaschinen AG, Offenbach am Main, Fed. Rep. of Germany

[21] Appl. No.: 498,086

[22] Filed: Mar. 22, 1990

[30] Foreign Application Priority Data

Apr. 1, 1989 [DE] Fed. Rep. of Germany ..... 3910497

[51] Int. Cl.[5] ..... B41F 9/10

[52] U.S. Cl. ..... 101/169; 101/157; 15/256.51

[58] Field of Search ..... 101/164–167, 101/169, 157, 168; 15/256.51, 256.52; 118/261

[56] References Cited

U.S. PATENT DOCUMENTS

| | | | |
|---|---|---|---|
| 1,461,068 | 7/1923 | Regensteiner | 101/169 |
| 1,773,949 | 5/1930 | Casto | 101/157 |
| 2,974,586 | 3/1961 | Hunt | 101/157 |

FOREIGN PATENT DOCUMENTS

| | | | |
|---|---|---|---|
| 0110249 | 4/1944 | Sweden | 15/256.51 |
| 0879560 | 10/1961 | United Kingdom | 15/256.51 |

OTHER PUBLICATIONS

Xerox Disclosure Journal, vol. 2, No. 6, Nov./Dec. 1977.

*Primary Examiner*—Edgar S. Burr
*Assistant Examiner*—C. A. Bennett
*Attorney, Agent, or Firm*—Frishauf, Holtz, Goodman & Woodward

[57] ABSTRACT

A doctor blade holder has two holder parts (4, 5) to clamp a doctor blade (3) with a straight edge therebetween. The holder parts define opposed holder surfaces (6, 7), which, at least in part, form surfaces of an elliptical cylinder which has a cross-sectional form in the shape of an ellipse (Z) which has a longitudinal axis (B—B) which intersects the longitudinal axis (A—A) of the cylinder by an angle of inclination ($\alpha$) which, customarily, is in the order of between 0.1° to 1°, but may be substantially larger. The minor half-axis of the ellipse (Z) is equal to the radius (r) of the printing machine cylinder (1) and the major half-axis of the ellipse (Z) is longer than the length (1) of the printing machine cylinder against which the doctor blade edge is engaged.

8 Claims, 3 Drawing Sheets

HOLDER SYSTEM FOR A PRINTING MACHINE DOCTOR BLADE

FIELD OF THE INVENTION

The present invention relates to printing machines, and more particularly to printing machines including doctor blades to strip substances from the surface of a cylinder or roller, and especially to a holder arrangement or holder system for a doctor blade which is engaged against a cylinder of the printing machine at an inclination with respect to the axis of the cylinder.

BACKGROUND

It is known to engage a doctor blade at an inclination with respect to the axis of a roller or cylinder of a printing machine, especially if the roller or cylinder includes a gap or groove to clamp a cover thereover, for example the ends of a printing plate. Locating the doctor blade at an angle facilitates sliding of the doctor blade over the gap or groove. This is explained in the cited literature, "Der Tiefdruck" ("Gravure Printing") by Braun, 1952, p. 139.

When engaging a doctor blade against a cylinder, at an angle with respect to the cylinder axis when the doctor blade is held in the usual holder arrangements, the doctor blade has the tendency to become wavy or to undulate, especially when it is tried to engage the doctor blade over its entire length against the cylinder. The tendency to waviness or undulation increases with the inclination angle of the doctor blade with respect to the axis of the cylinder. The formation of waves or undulations makes the engagement pressure of the blade against the cylinder non-uniform over the length of the blade. If it is tried to so tightly engage the doctor blade against the cylinder that the required minimum engagement pressure is available at any position, then some locations of the blade are more tightly engaged than others, thus causing increased wear on the doctor blade and/or the cylinder.

THE INVENTION

It is an object to provide a doctor blade holder arrangement which permits engagement of the doctor blade against a cylinder with uniform engagement pressure, extending over the entire length of the cylinder, or the doctor blade, respectively.

Briefly, a holder structure is provided defining opposed holder surfaces between which the doctor blade is clamped. The holder surfaces, at least in part, form surfaces of an elliptical cylinder, erected on a base ellipse, which base ellipse has a longitudinal axis which intersects the longitudinal axis of the cylinder by the angle of inclination, and which has a shorter half-axis which is equal to the radius r of the cylinder; the longer half axis of the ellipse is longer than the length 1 of the cylinder.

DRAWINGS

DETAILED DESCRIPTION

Figure 3:
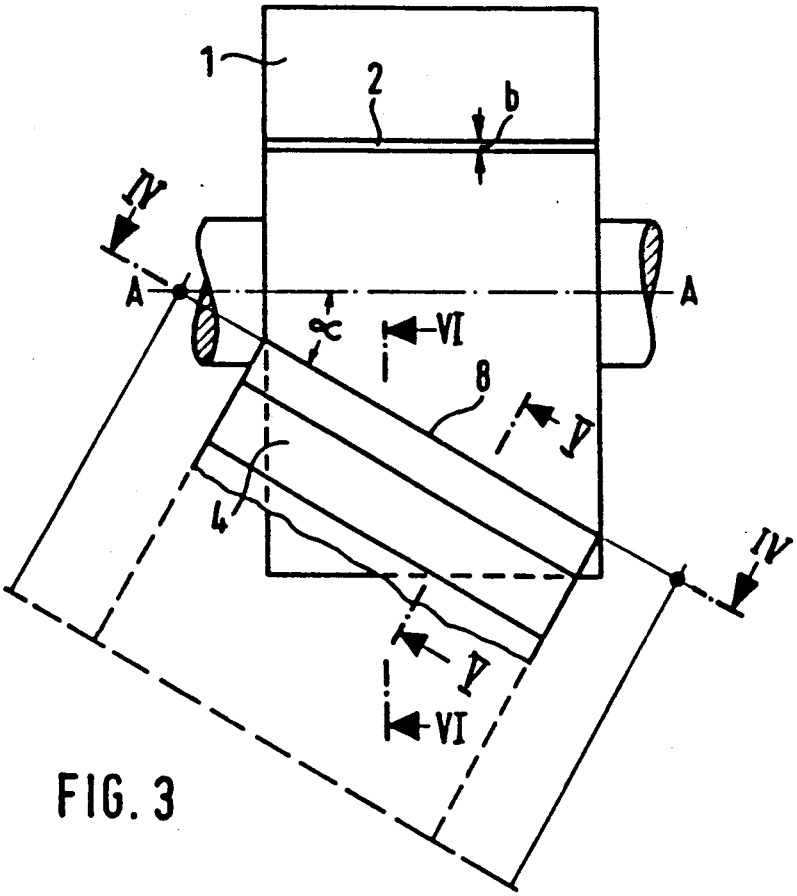
FIG. 3 is a schematic top view looking on the doctor blade in engagement with the cylinder.
Figure 5:
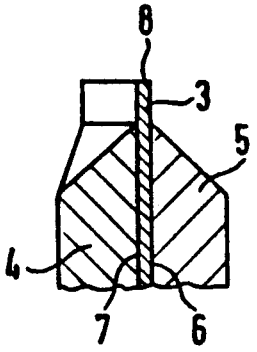
FIG. 5 is a cross section along the line V—V of FIG. 3.

The basic arrangement of the doctor blade in engagement with the cylinder is best seen in FIG. 3. The cylinder 1, shown greatly foreshortened for purposes of illustration, has a longitudinal axis A—A. The cylinder 1 has an axially extending gap or groove 2 with a width b, used for example to attach a cover over the cylinder, for example a gravure plate. A doctor blade 3 is engaged against the cylinder 1, and held in a holder element which has two opposed holder parts, namely an upper part 4 and a lower part 5. The parts or portions 4, 5 clamp the doctor blade 3, as well known, and not further shown, for example by suitable clamping screws, which is a simple connection. The doctor blade 3 should be inclined by an angle with respect to the longitudinal axis A—A. FIG. 3 shows this angle greatly exaggerated; in actual practice, the angle is between about 0.1° and 1°. This angle is to be so selected that when the gap 2 runs beneath the doctor blade 3, at least a portion of the doctor blade will be in engagement with the surface of the cylinder 1, so that the doctor blade 3 cannot drop into or catch in the gap or groove 2.

Figure 1:
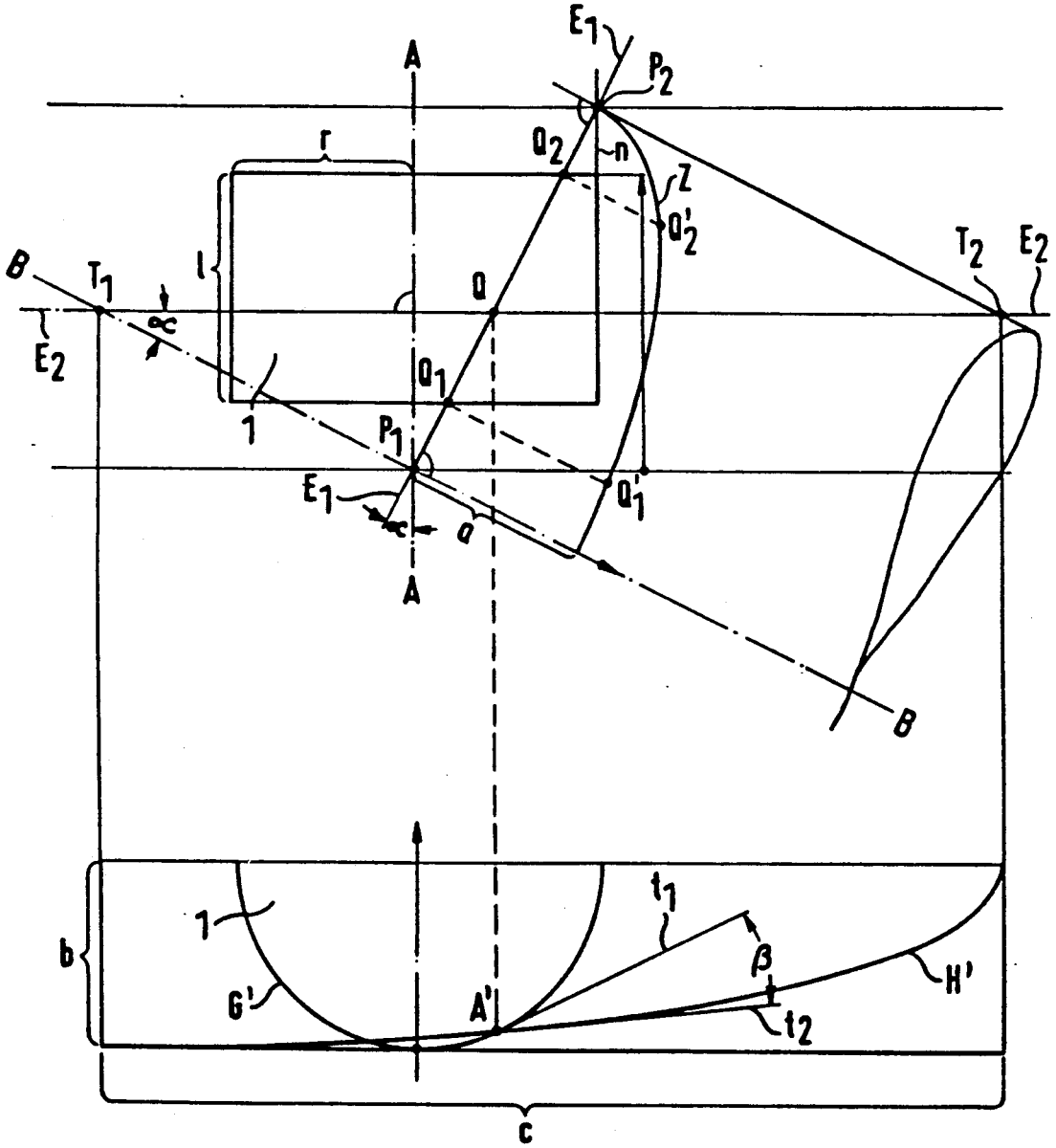
FIG. 1 is a schematic illustration of the geometric relationships which occur upon engaging a blade against a cylinder.
Figure 2:
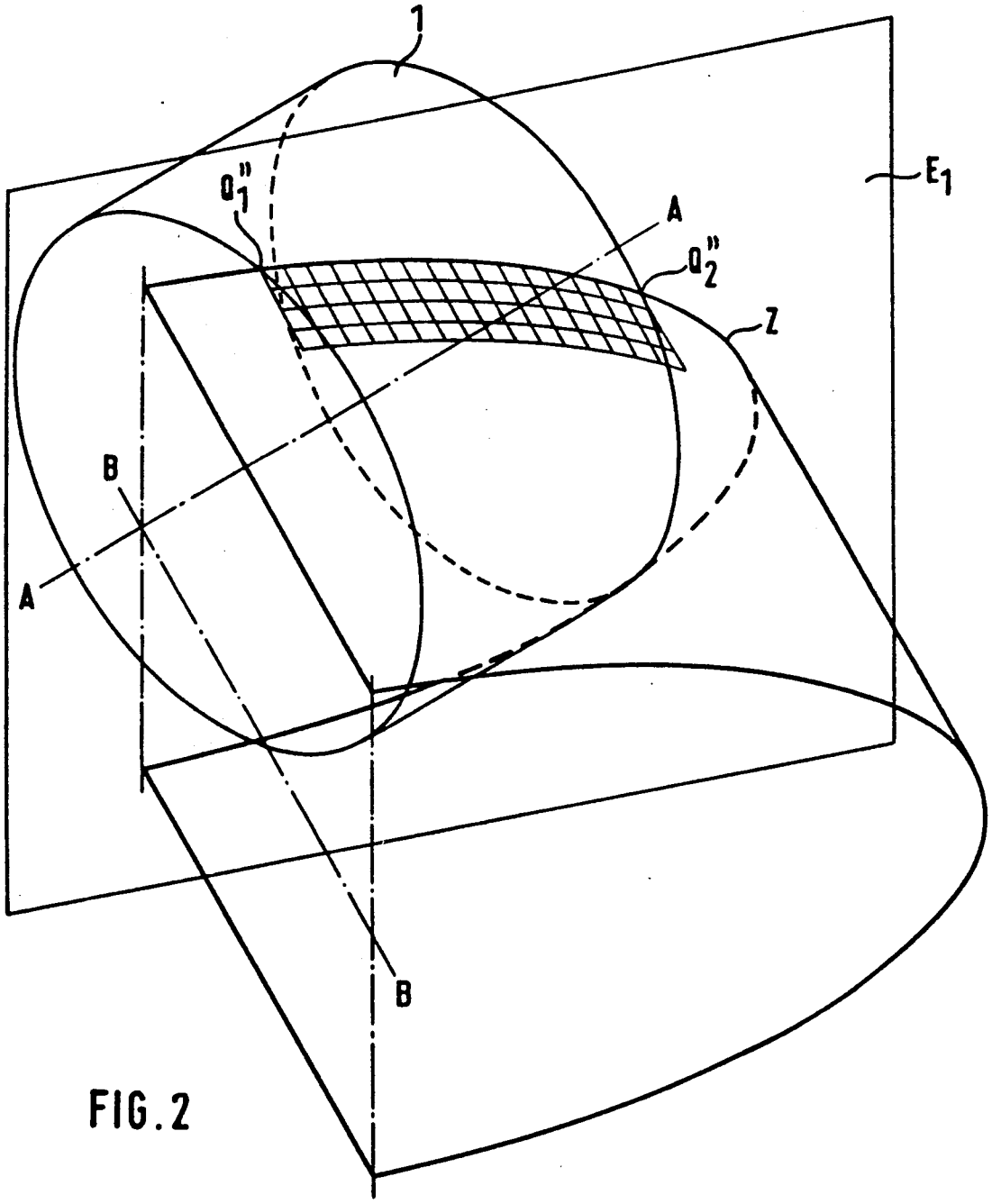
FIG. 2 is a perspective diagrammatic view of the intersecting surfaces of the cylinder and the doctor blade.

FIGS. 1 and 2, which are provided for the explanation of the holder arrangement for the doctor blade, will now be referred to. The angle $\alpha$, again, is shown highly exaggerated for illustrative purposes.

A base plane is extended through the longitudinal axis A—A of the printing cylinder 1. The printing cylinder has a radius r and a length 1. This base plane is coincident with the plane of the drawing. A plane $E_1$ (FIG. 2) is placed transversely to the plane of the drawing, which intersects the longitudinal axis A—A under the desired inclination angle The plane $E_1$ intersects the longitudinal axis A—A at a point $P_1$ and a circumferential line which falls within the base plane, that is the plane of the paper, of the surface of the printing cylinder 1 at the point $P_2$. This plane $E_1$, further, intersects the printing cylinder 1 between the points $Q_1$ and $Q_2$. The points $P_1$ and $P_2$ are outside of the region of the printing cylinder 1, and their spacing substantially exceeds the length of the printing cylinder 1.

Upon flipping the plane $E_1$ with the intersecting line $Q_1$–$Q_2$ by 90° into the initial plane, that is, the plane of the drawing, a curve $Q_1'$–$Q_2'$ (FIG. 1) will be obtained; in FIG. 2. This curve is part of an ellipse Z having a major half-axis $P_1$–$P_2$ and a minor half-axis a, which is equal to the radius r of the printing cylinder 1. Only half of the ellipse Z and the elliptical cylinder which can be erected thereon is shown in FIGS. 1 and 2.

An elliptical cylinder with a longitudinal axis B—B can be erected on the ellipse Z, perpendicularly to the plane $E_1$. By selection of the angle of inclination $\alpha$, and thus the required shape and position of the elliptical cylinder, an inclination angle will result for any point along the intersecting line $Q_1$–$Q_2$ between the surfaces of the cylinder 1 and the elliptical cylinder.

Placing, through any randomly selected point Q of the intersecting line $Q_1$–$Q_2$ a plane $E_2$ which extends at right angle to the base plane of the system, that is, the plane of the drawing of FIG. 1, and which additionally is perpendicular to the longitudinal axis A—A of the printing cylinder 1, then this plane $E_2$ will intersect the printing cylinder in a circle and the elliptical cylinder in an ellipse.

Flipping or rotating the plane $E_2$ by 90° into the base plane, that is, the plane of the drawing of FIG. 1, one obtains the circle G' (FIG. 1) of a portion of the ellipse H'. The minor half-axis b of the ellipse H' is equal to the radius r of the cylinder 1, and the major half-axis c corresponds to the distance $T_1$–$T_2$.

The tangent $t_1$ to the circle G' and the tangent $t_2$ on the ellipse H' include an angle $\beta$, which is the engagement angle of the elliptical cylinder on the printing machine cylinder at the selected point Q. The angle $\beta$ varies for a selected elliptical cylinder Z within narrow limits, in dependence on the position of the point Q on the intersecting line $Q_1$–$Q_2$. The value of the average of the angle $\beta$ is determined by the selection of the angle of inclination $\alpha$ of the doctor blade with respect to the axis A—A of the cylinder, and the position of the point $P_1$ on the axis A—A of the cylinder 1.

Point A' shown in the lower region of FIG. 1 corresponds to point Q in the upper region.

The line $Q_1''$–$Q_2''$, that is, the intersection of the cylinder 1 with the elliptical theoretical cylinder, can be considered the connecting or engagement line of the doctor blade 3 with the printing cylinder 1. If this is done, the adjacent surface of the elliptical cylinder defines a curved surface which can be developed in a plane. This surface is shown in FIG. 2 in square-hatched representation.

Figure 4:
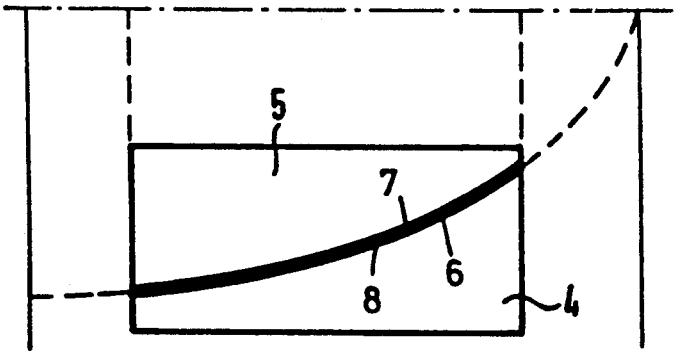
FIG. 4 is a view of the holder arrangement for the doctor blade in the direction of the arrows IV—IV.
Figure 6:
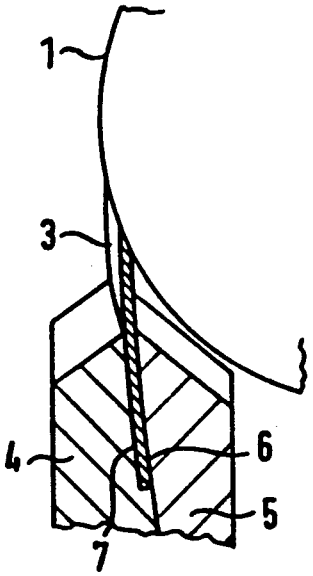
FIG. 6 is a cross-sectional view along line VI—VI of FIG. 3.

In accordance with a feature of the invention, doctor blade engagement surfaces 6, 7 are formed on the lower and upper sections 5, 4 of the doctor blade holder. By clamping the doctor blade between these surfaces, a flat but flexible doctor blade 3 can be so clamped that the blade edge 8 thereof will engage along the line $Q_1''$–$Q_2''$ (FIG. 2), uniformly, against the printing cylinder 1. This is illustrated in FIGS. 2–4. The angle then also will form the engagement angle of the doctor blade 3 against the printing cylinder 1.

The clamping arrangement, in accordance with the invention, has the advantage that an inherently flexible doctor blade which has a straight blade edge 8 can be used while still providing perfect engagement of the edge 8 over its entire length on the printing cylinder. This advantage is obtained also if the angle of inclination is greater than the customary angle of between 0.1° and 1°, that is, with substantially larger angles of inclination.

We claim:

1. Holder system for a doctor blade (3) in which the doctor blade is engaged against a cylinder (1) of a printing machine with an angle ($\alpha$) of inclination with respect to the axis (A—A) of the cylinder, comprising, in accordance with the invention, a holder structure (4,5) defining opposed holder surfaces (7,6) between which the doctor blade (3) is clamped, and wherein said surfaces at least in part form the surfaces of an elliptical cylinder having a longitudinal axis (B—B) and a cross-section perpendicular to said longitudinal axis in the form of an ellipse (Z) lying in a plane (E1) which intersects the axis (A—A) of said printing machine cylinder at said angle ($\alpha$) at a point where said longitudinal axis of said elliptical cylinder intersects said axis of said printing machine cylinder, and wherein the minor half-axis of the ellipse (Z) is equal to the radius (r) of the printing machine cylinder (1), and the major half-axis of the ellipse (Z) is longer than the length (1) of the printing machine cylinder (1).

2. The system of claim 1, wherein the cylinder (1) is formed with an axial gap or groove (2) in its surface;

and said angle ($\alpha$) is a small angle selected to place the doctor blade across said gap or groove upon rotation of the cylinder past the doctor blade, whereby at least a portion of the doctor blade will, at any position of the cylinder, be in surface engagement with the cylinder (1).

3. The system of claim 1, wherein said angle ($\alpha$) is between about 0.1° and 1°.

4. The system of claim 2, wherein said angle ($\alpha$) is between about 0.1° and 1°.

5. The system of claim 1, wherein said doctor blade (3) has a straight edge (8).

6. The system of claim 2, wherein said doctor blade (3) has a straight edge (8).

7. The system of claim 3, wherein said doctor blade (3) has a straight edge (8).

8. The system of claim 4, wherein said doctor blade (3) has a straight edge (8).

* * * * *